United States Patent [19]

Bergot

[11] 4,344,119

[45] Aug. 10, 1982

[54] HEADLAMPS HAVING SEALED OPTICAL UNITS AND REPLACEABLE LIGHT BULBS

[75] Inventor: Thierry Bergot, Paris, France

[73] Assignee: Cibie Projecteurs, Bobigny, France

[21] Appl. No.: 164,999

[22] Filed: Jul. 1, 1980

[30] Foreign Application Priority Data

Jul. 19, 1979 [FR] France ..... 79 18697

[51] Int. Cl.[3] ..... F21V 29/00

[52] U.S. Cl. ..... 362/267; 362/307; 362/310

[58] Field of Search ..... 362/267, 307, 310

[56] References Cited

U.S. PATENT DOCUMENTS 3,553,519 1/1971 Hicks ..... 362/307

*Primary Examiner*—Stephen J. Lechert, Jr.
*Attorney, Agent, or Firm*—Alan H. Levine

[57] ABSTRACT

A vehicle headlamp has a sealed optical unit comprising a front lens, a reflector having a rear opening, and a transparent cup-shaped pocket fitted in the rear opening of the reflector. The cup-shaped pocket projects forwards into the space between the reflector and the front lens, so that light rays from a light bulb mounted within the pocket can reach the reflecting surface of the reflector, but the reflecting surface of the reflector is nonetheless inaccessible to contaminants from outside the headlamp. The lower part of the reflector should not reflect light rays from the light bulb, or at least from a dipped-beam filament of the light bulb, in order to avoid unwanted upwardly-directed rays being produced by the headlamp. Rays can be prevented from reaching the lower part of the reflector directly from the filament by means of a shield, while rays from the filament which are reflected from the surface of the transparent pocket are prevented from reaching the reflector by making the pocket with an outward flare towards the rear, so that any rays reflected by the pocket are directed towards the rear opening of the reflector, rather than towards the reflecting surface of the reflector.

6 Claims, 4 Drawing Figures

HEADLAMPS HAVING SEALED OPTICAL UNITS AND REPLACEABLE LIGHT BULBS

FIELD OF THE INVENTION

This invention relates to headlamps having sealed optical units and replaceable light bulbs.

BRIEF DESCRIPTION OF THE DRAWINGS OF THE PRIOR ART

In the accompanying drawings:

FIG. 1 is a longitudinal section through the axis of a headlamp of previously-proposed type; and FIG. 2 is a section, similar to part of FIG. 1, to an enlarged scale, illustrating the paths followed by certain light rays in the headlamp of FIG. 1.

DESCRIPTION OF THE PRIOR ART

Headlamps of the type having a sealed optical unit and a replaceable light bulb are already known from, for example, U.S. Pat. No. 2,423,664. FIG. 1 illustrates a headlamp of this type; in this headlamp, the optical unit comprises a front lens 15 and a reflector 10, which are permanently sealed together, for example by means of an apoxy resin adhesive. The reflector 10 has a central opening 12, and a cup-shaped transparent glass pocket 20 is permanently sealed in place (again, possibly by means of an adhesive) in the opening 12, with the pocket 20 projecting forwards into the space enclosed between the lens 15 and the reflector 10. A bulb 30 is removably mounted in the opening 12, with its filament (shown at 31) lying on the axis of the reflector 10, near the focus of the reflector. Thus, although the light rays from the filament 31 can reach the reflecting surface of the reflector 10 by passing through the wall of the pocket 20, the reflecting surface is completely inaccessible to contaminants from outside the headlamp, because it lies within the closed space formed by the reflector 10, the lens 15 and the pocket 20.

Such a construction has certain disadvantages. The pocket 20 may show a tendency to vibrate, and if, as in the headlamp shown in FIG. 1, the pocket is not an integral part of the reflector, the joint between the pocket and the reflector may fail as a result of this vibration. If any water should enter the pocket 20, this water may be unable to escape, and a layer of water may be formed over the internal surface of the pocket 20 by condensation of water vapour on this surface; this impairs the optical performance of the headlamp. Also, the use of a pocket 20 with cylindrical walls, as illustrated in FIG. 1, may lead to the formation of stray light rays directed in unwanted directions. FIG. 2 illustrates how such stray rays are formed.

In FIG. 2, the filament 31 is illustrated as a dipped-beam filament, that is to say, it is positoned slightly forwards of the focus (shown at F) of the reflector 10. A main beam filament (not shown) is also provided, slightly to the rear of the focus F; light rays from the main beam filament can reach all parts of the reflector 10, whereas a shield (not shown) is provided beneath the dipped-beam filament 31, to prevent rays from reaching the lower part of the reflector 10 directly from the filament 31; it will be appreciated that such rays would be directed slightly upwards after reflection from the reflector 10. However, rays from the filament 31 can still reach the lower part of the reflector 10 by partial reflection from the surfaces of the pocket 20, as indicated by two rays $R_1$ and $R_2$. The ray $R_1$, after partial reflection from the inside surface of the pocket 20, recrosses the optical axis (shown at 0-0) of the reflector 10 at a point forward of the focus F, and will therefore be directed upwards, as shown at $R_{S1}$, after reflection by the reflector 10. The ray $R_2$, after partial reflection by the pocket 20, recrosses the axis 0-0 at a point to the rear of the focus F, so that the ray reflected by the reflector 10 will be downwardly directed. However, the front lens 15 may in many cases be formed with prisms, as shown at p, for the purpose of raising the lowest rays of the main beam produced by the headlamp, and these prisms will have the effect of raising the reflected stray ray $R_2$, so that it becomes upwardly directed, as indicated at $R_{S2}$. It will be appreciated that upwardly directed stray rays such as $R_{S1}$ and $R_{S2}$ are completely unwanted in a dipped headlamp beam.

SUMMARY OF THE INVENTION

It is an object of the invention to eliminate at least some of the shortcomings of the prior art.

Thus, the present invention provides, in a headlamp of the type having a sealed optical unit comprising a reflector having front and rear openings, a front lens closing the front opening of the reflector, and a transparent cup-shaped pocket closing the rear opening of the reflector and projecting into the interior of the sealed optical unit, the headlamp also including a light source removably fitted within the transparent pocket, the improvement comprising:

forming the transparent pocket with a portion flared outwardly towards the rear opening of the reflector, at least in the part of the pocket closest to the light source, such that any rays from the light source which are reflected from the said flared portion of the pocket are directed to pass out of the rear opening of the reflector, rather than being reflected by the reflector.

In the preferred embodiment, the flared portion of the pocket has substantially the shape of part of a prolate ellipsoid having two foci, one of the said foci being close to the light source, while the other of the said foci lies to the rear of the said one focus.

As indicated above, it is particularly important to suppress light rays which are directed in unwanted directions when the headlamp is required to produce a dipped beam. Thus, the invention is particularly applicable in cases wherein the reflector has an axis and a focal point, and the light source is a dipped-beam filament of a headlamp bulb, which filament is displaced along the said axis from the focal point of the reflector, and the filament is provided with a shield which prevents certain light rays from the filament from reaching a predetermined part of the reflector. This is a conventional arrangement for producing a dipped beam, but the shield may be unable to intercept light rays which are reflected from the pocket, so that, if these reflected stray rays are directed towards the said predetermined part of the reflector, they will emerge from the headlamp in an unwanted direction (that is to say, an upwardly inclined direction). Thus, the flared portion of the pocket should be so shaped that any rays from the light source which are reflected from the said flared portion are prevented from reaching at least the said predetermined part of the reflector, since this is the part of the reflector which is potentially capable of producing rays directed in unwanted directions.

The headlamp bulb may also include a main-beam filament disposed rearwards of the focal point of the reflector, such that light rays from the main-beam filament can reach substantially all parts of the reflector. Thus, the said predetermined part of the reflector is used for producing the main beam, but is prevented by the shield and by the use of the present invention from producing any unwanted rays when only the dipped-beam filament is in use.

BRIEF DESCRIPTION OF THE DRAWINGS OF THE PREFERRED EMBODIMENT

FIG. 3 is a longitudinal section through the axis of a headlamp embodying the invention; and FIG. 4 is a section, similar to part of FIG. 3, to an enlarged scale, illustrating the paths followed by certain light rays in the headlamp of FIG. 3.

The same reference numerals will be used in FIGS. 3 and 4 as were used for corresponding parts in FIGS. 1 and 2.

DETAILED DESCRIPTION OF THE PREFERRED EMBODIMENT

Figure 3:
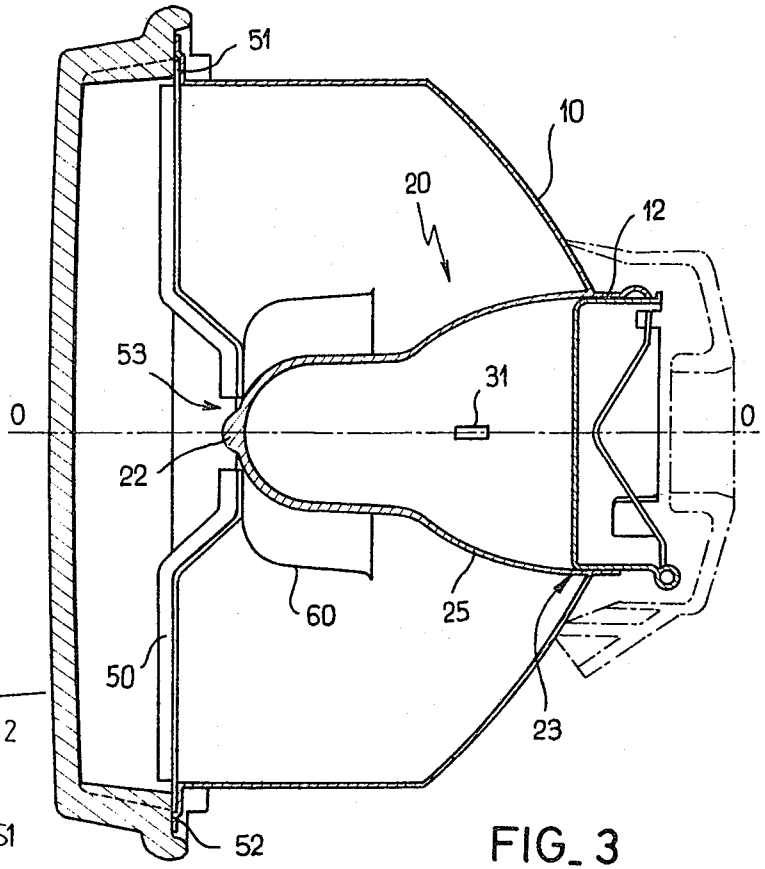

The headlamp shown in FIG. 3 includes a front lens, a reflector 10 having a rear opening 12, and a light bulb (not shown) having a filament 31. Normally, the filament 31 would be a dipped-beam filament, and the light bulb would also have a main-beam filament (not shown in FIG. 3) to the rear of the filament 31, and a shield (also not shown in FIG. 3) disposed below the dipped-beam filament 31. These elements do not differ in essentials from the corresponding parts in FIG. 1. The headlamp of FIG. 1 also includes a transparent pocket 20 permanently sealed in the reflector opening 12, with the light bulb being mounted within the pocket. However, unlike the pocket 20 shown in FIG. 1, the parts of the pocket 20 shown in FIG. 3 which lie closest to the filament 31 flare outwardly towards the rear, as shown at 25; in the embodiment shown in FIG. 3, this flare continues as far as the rear edge of the pocket 20, which edge is shown at 23.

By using a pocket having this flared shape, certain of the disadvantages of the prior art may be eliminated. Since most parts of the lower wall of the pocket 20 slope downwards towards the opening 12, any water entering the pocket 20 can more readily drain out again. Also, the use of a pocket of this shape eliminates the stray rays $R_{S1}$ and $R_{S2}$ of FIG. 2, in a manner which will now be described with reference to FIG. 4.

Figure 4:
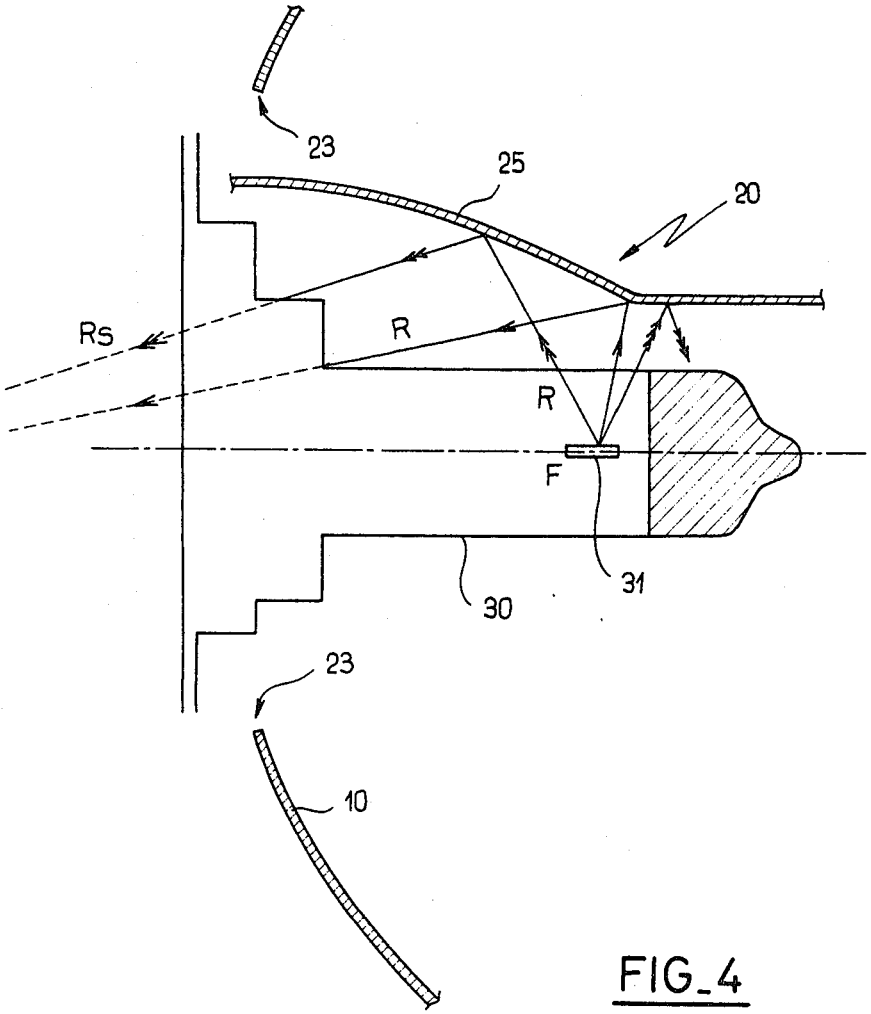

As FIG. 4 shows, any light rays from the filament 31 which strike the upper part of the flared part 25 of the pocket 20 are partially reflected in a rearwards direction, so that they strike the base of the light bulb and are absorbed. There is thus no possibility of these partially reflected rays being reflected by the reflector 10 and being emitted through the front lens 15 in unwanted directions.

In a preferred form, the flared part 25 of the pocket 20 has substantially the shape of part of a prolate ellipsoid, with both its foci lying on the axis 0-0 of the reflector 10, and with the filament 31 (or, in the case where the light bulb has more than one filament, the filament nearest the front lens of the headlamp) lying at the focus of the ellipsoid which is closer to the front lens, while the other focus of the ellipsoid lies far enough to the rear that the stray rays, which will be directed towards this focus after reflection from the surface of the ellipsoid, will all strike the base of the light bulb and be absorbed. Preferably the second focus of the ellipsoid lies outside the rear opening 12 of the reflector 10.

Figure 1:
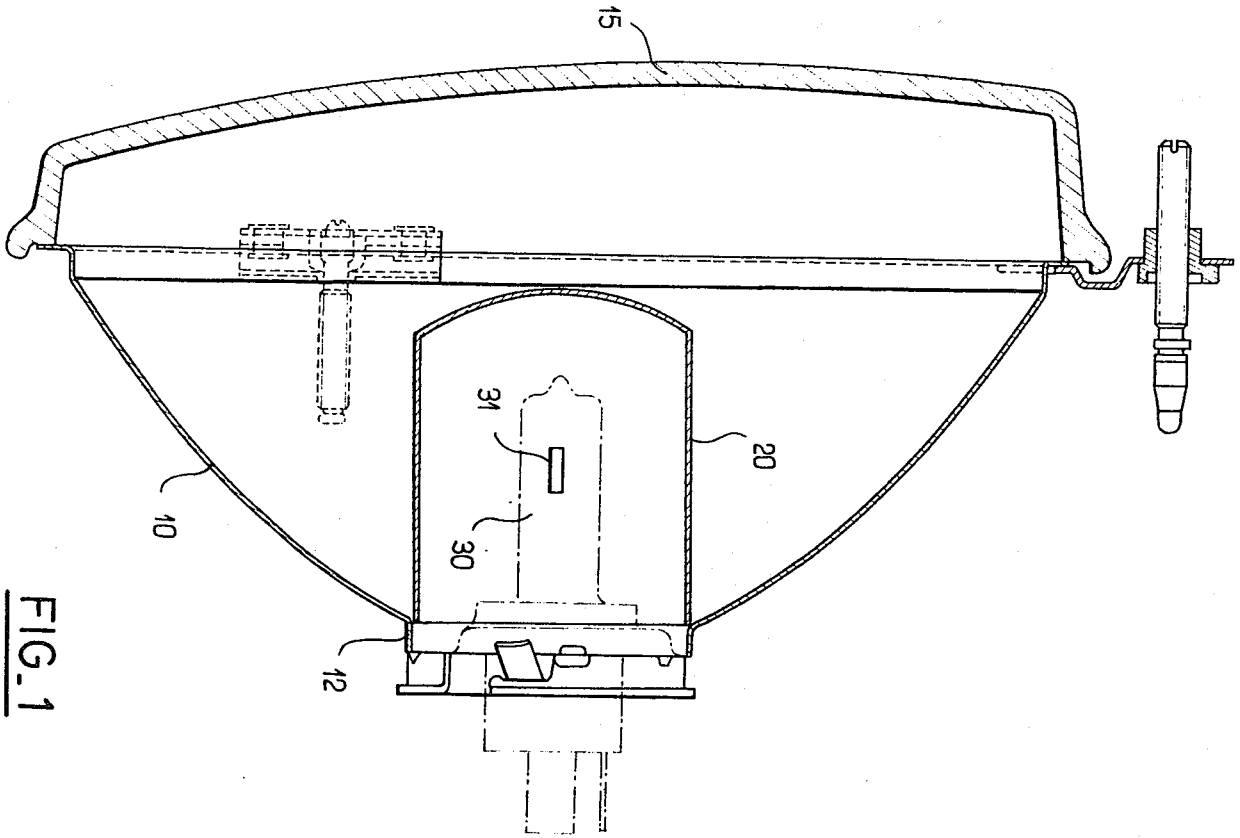
Figure 2:
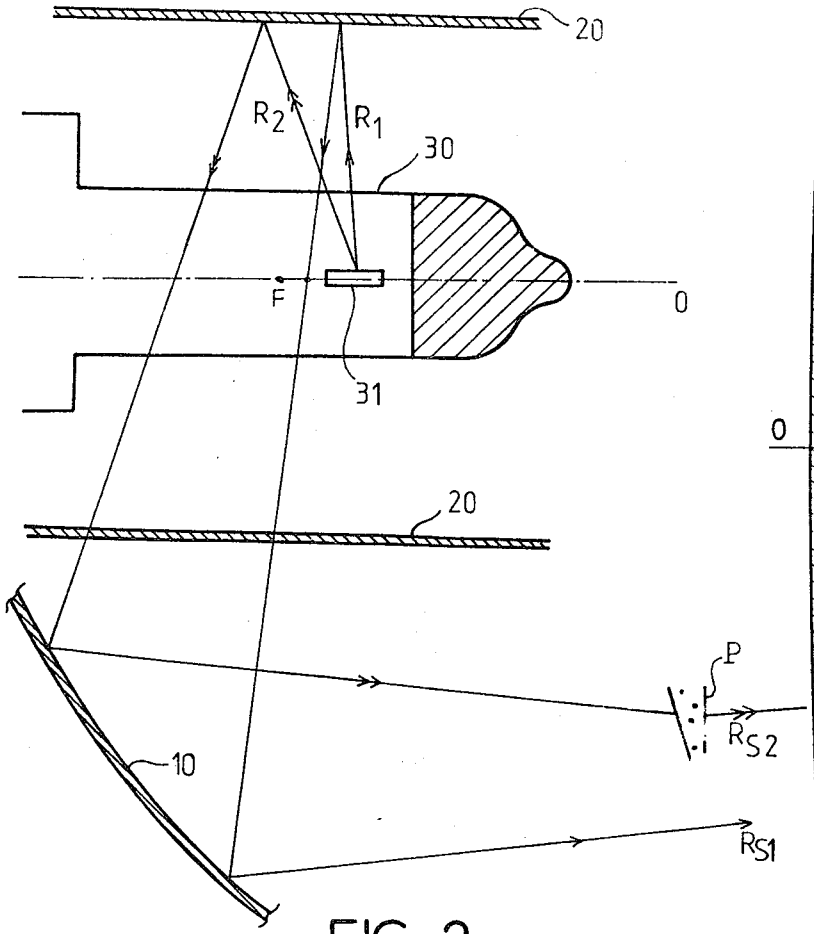

The pocket 20 of FIGS. 3 and 4 can be manufactured in various ways. For example, it may be made initially as a glass pocket with cylindrical walls, as illustrated in FIGS. 1 and 2, and these walls may then be expanded by the insertion of a shaping tool, while the pocket 20 is hot.

FIG. 3 also shows a supporting strut 50, which is mounted between the front lens and the reflector 10 by its two ends 51 and 52, and which has at its centre an opening 53, in which the apex (shown at 22) of the pocket 20 is supported. In this way, vibrations of the pocket 20 can be largely prevented. FIG. 3 also shows how the strut 50 may carry a cup-shaped shield 60 which surrounds the front part of the pocket 20, to prevent light rays from reaching the front lens of the headlamp without reflection by the reflector 10.

I claim:

1. In a headlamp of the type having a sealed optical unit comprising a reflector having front and rear openings, a front lens closing said front opening of said reflector, and a transparent cup-shaped pocket closing said rear opening of said reflector and projecting into the interior of said sealed optical unit, said headlamp also including a light source removably fitted within said transparent pocket, the improvement comprising:

said transparent pocket having a portion flared outwardly towards said rear opening of said reflector, at least in the part of said pocket closest to said light source, such that any rays from said light source which are reflected from said flared portion of said pocket are directed to pass out of said rear opening of said reflector, rather than being reflected by said reflector.

2. A headlamp according to claim 1, wherein said flared portion of said pocket has substantially the shape of part of a prolate ellipsoid having two foci, one of the said foci being close to said light source, while the other of said foci lies to the rear of the said one focus.

3. A headlamp according to claim 1 or claim 2, wherein said reflector has an axis and a focal point, and said light source is a dipped-beam filament of a headlamp bulb, which filament is displaced along said axis from said focal point of said reflector, said filament being provided with a shield which prevents certain light rays from the said filament from reaching a predetermined part of said reflector, said light rays having such directions that, if reflected from said reflector, said light rays would then be inclined upwards with respect to said axis, and said flared portion of said pocket being so shaped that any rays from said light source which are reflected from said flared portion are prevented from reaching at least said predetermined part of said reflector.

4. A headlamp according to claim 3, wherein said dipped-beam filament is disposed forward of said focal point of said reflector, and said shield is disposed below said filament, whereby said predetermined part of said reflector is the lower part of said reflector.

5. A headlamp according to claim 4, wherein said headlamp bulb also includes a main-beam filament disposed rearwards of said focal point of said reflector, such that light rays from said main-beam filament can reach substantially all parts of said reflector.

6. A headlamp according to claim 1 or claim 2, which also includes a strut extending across said reflector and supporting said pocket at a position remote from said rear opening of said reflector.

* * * * *